US010975809B2

(12) United States Patent
Asanuma

(10) Patent No.: US 10,975,809 B2
(45) Date of Patent: Apr. 13, 2021

(54) EVAPORATED FUEL PROCESSING DEVICE, PURGE GAS CONCENTRATION DETECTION METHOD, AND CONTROL DEVICE FOR EVAPORATED FUEL PROCESSING DEVICE

(71) Applicant: AISAN KOGYO KABUSHIKI KAISHA, Obu (JP)

(72) Inventor: Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/486,617

(22) PCT Filed: Dec. 27, 2017

(86) PCT No.: PCT/JP2017/047115

§ 371 (c)(1),
(2) Date: Aug. 16, 2019

(87) PCT Pub. No.: WO2018/163578

PCT Pub. Date: Sep. 13, 2018

(65) Prior Publication Data

US 2020/0232422 A1 Jul. 23, 2020

(30) Foreign Application Priority Data

Mar. 9, 2017 (JP) ..... JP2017-044918

(51) Int. Cl.
*F02M 25/08* (2006.01)

(52) U.S. Cl.
CPC ..... *F02M 25/0836* (2013.01)

(58) Field of Classification Search
CPC ..... F02M 25/0836
(Continued)

(56) References Cited

U.S. PATENT DOCUMENTS 5,746,187 A 5/1998 Ninomiya et al.
7,409,947 B2 8/2008 Koyama
(Continued)

FOREIGN PATENT DOCUMENTS

JP H06-101534 A 4/1994
JP H09-072254 A 3/1997
(Continued)

OTHER PUBLICATIONS

Written Opinion (WO) for PCT/JP2017/047115 dated Mar. 6, 2018 (12 pages including English Translation).
(Continued)

*Primary Examiner* — David Hamaoui
*Assistant Examiner* — John D Bailey
(74) *Attorney, Agent, or Firm* — Shumaker, Loop & Kendrick, LLP

(57) ABSTRACT

When a purge control valve is in a supply state of supplying purge gas from a canister to an intake pipe and a pump is in operation, a concentration detector is configured to detect a concentration of the purge gas when the purge control valve is open in a case where a duty cycle of the purge control valve is not less than a predetermined value, and detect a concentration of the purge gas when the purge control valve is closed in a case where the duty cycle of the purge control valve is less than the predetermined value.

9 Claims, 9 Drawing Sheets

(58) Field of Classification Search
USPC ..... 123/519
See application file for complete search history.

(56) References Cited

U.S. PATENT DOCUMENTS

| | | | | |
|---|---|---|---|---|
| 2006/0144373 | A1* | 7/2006 | Kano | F02D 41/0045 123/519 |
| 2007/0137622 | A1* | 6/2007 | Koyama | F02M 25/089 123/520 |
| 2017/0152798 | A1* | 6/2017 | Casetti | F02M 25/0854 |
| 2017/0152802 | A1* | 6/2017 | Casetti | F02D 41/1454 |
| 2017/0152814 | A1* | 6/2017 | Casetti | F02M 25/0836 |
| 2017/0159588 | A1* | 6/2017 | Honjo | B01D 53/0454 |
| 2017/0234270 | A1* | 8/2017 | Tochihara | F02M 25/0854 123/519 |
| 2019/0211760 | A1* | 7/2019 | Choi | F02M 35/10222 |
| 2019/0211769 | A1* | 7/2019 | Dudar | F02D 41/1441 |
| 2020/0141361 | A1* | 5/2020 | Nakagawa | F02M 25/0836 |

FOREIGN PATENT DOCUMENTS

| | | | |
|---|---|---|---|
| JP | H09-112309 | A | 4/1997 |
| JP | 2002-115605 | A | 4/2002 |
| JP | 2007-170221 | A | 7/2007 |

OTHER PUBLICATIONS

English Translation of International Search Report (ISR) for PCT/JP2017/047115 dated Mar. 6, 2018 (2 pages).

* cited by examiner

FIG. 7

(%)

| Pump Rotational Speed (rpm) \ ΔP (Pa) | 0 | 2 | 4 | 6 | 8 | 10 | 12 | 14 | 16 | 18 | 20 |
|---|---|---|---|---|---|---|---|---|---|---|---|
| 10000 | A1 | A2 | A3 | A4 | A5 | A6 | A7 | A8 | A9 | A10 | A11 |
| 20000 | B1 | B2 | B3 | B4 | B5 | B6 | B7 | B8 | B9 | B10 | B11 |
| 30000 | C1 | C2 | C3 | C4 | C5 | C6 | C7 | C8 | C9 | C10 | C11 |
| 40000 | D1 | D2 | D3 | D4 | D5 | D6 | D7 | D8 | D9 | D10 | D11 |
| 50000 | E1 | E2 | E3 | E4 | E5 | E6 | E7 | E8 | E9 | E10 | E11 |

FIG. 8

(%)

| Pump Rotational Speed (rpm) \ ΔP (Pa) | 0 | 2 | 4 | 6 | 8 | 10 | 12 | 14 | 16 | 18 | 20 |
|---|---|---|---|---|---|---|---|---|---|---|---|
| 10000 | a1 | a2 | a3 | a4 | a5 | a6 | a7 | a8 | a9 | a10 | a11 |
| 20000 | b1 | b2 | b3 | b4 | b5 | b6 | b7 | b8 | b9 | b10 | b11 |
| 30000 | c1 | c2 | c3 | c4 | c5 | c6 | c7 | c8 | c9 | c10 | c11 |
| 40000 | d1 | d2 | d3 | d4 | d5 | d6 | d7 | d8 | d9 | d10 | d11 |
| 50000 | e1 | e2 | e3 | e4 | e5 | e6 | e7 | e8 | e9 | e10 | e11 |

EVAPORATED FUEL PROCESSING DEVICE, PURGE GAS CONCENTRATION DETECTION METHOD, AND CONTROL DEVICE FOR EVAPORATED FUEL PROCESSING DEVICE

TECHNICAL FIELD

The disclosure herein discloses a technique related to an evaporated fuel processing device, especially, a technique related to an evaporated fuel processing device that supplies evaporated fuel generated in a fuel tank to an intake pipe of an engine and processes the same.

BACKGROUND ART

Japanese Patent Application Publication No. H6-101534 (hereinbelow termed Patent Document 1) describes an evaporated fuel processing device. The evaporated fuel processing device of Patent Document 1 is provided with a sensor for specifying a fluid density of air introduced to a canister and a sensor for specifying a fluid density of purge gas delivered from the canister to an engine. The sensor for specifying a fluid density of the purge gas is provided between the canister and an intake pipe of the engine. The evaporated fuel processing device uses the fluid density of the air and the fluid density of the purge gas specified respectively by the two sensors while the purge gas is supplied from the canister to the engine to calculate a concentration of the purge gas based on a ratio or a difference between these fluid densities.

SUMMARY OF INVENTION

Patent Document 1 controls a supply amount of the purge gas to the intake pipe by controlling a duty cycle of a purge control valve upon delivering the purge gas to the intake pipe. Even within a purge period in which the purge gas is delivered to the engine (intake pipe), a state in which the purge gas is not delivered to the intake pipe due to the purge control valve being closed (closed state) and a state in which the purge gas is delivered to the intake pipe due to the purge control valve being open (open state) take place. When the purge control valve switches from the closed state to the open state, a purge gas concentration in a purge passage decreases. On the other hand, when the purge control valve switches from the open state to the closed state, the purge gas concentration in the purge passage increases. As above, since the purge gas concentration changes depending on timing when it is detected, the purge gas concentration cannot be detected accurately by conventional methods. The disclosure herein provides a technique that detects a concentration of purge gas accurately.

An evaporated fuel processing device disclosed herein may comprise a canister, a purge passage, a purge control valve, a pump, and a concentration detector. Evaporated fuel generated in a fuel tank may adhere to the canister. The purge passage may be connected between the canister and an intake pipe of an engine, and purge gas delivered from the canister to the intake pipe may pass therethrough. The purge control valve may be provided on the purge passage and be configured to switch between a supply state of allowing the purge gas to be supplied from the canister to the intake pipe and a blocking state of blocking supply of the purge gas from the canister to the intake pipe, and the purge control valve may be configured to control a supply amount of the purge gas to the intake pipe by a duty cycle in the supply state. The pump may be configured to feed the purge gas from the canister to the intake pipe. While the purge control valve is in the supply state and the pump is in operation, the concentration detector may detect a concentration of the purge gas when the purge control valve is open in a case where the duty cycle of the purge control valve is not less than a predetermined value, and detect a concentration of the purge gas when the purge control valve is closed in a case where the duty cycle of the purge control valve is less than the predetermined value.

The above evaporated fuel processing device is configured to change a timing to detect a concentration of the purge gas in the purge passage depending on the duty cycle of the purge control valve. The larger the duty cycle becomes, the longer the purge control valve is open. When the duty cycle is not less than the predetermined value, a period during which the purge control valve is open and the purge gas is supplied to the intake pipe is long. Due to this, in a case where the duty cycle is not less than the predetermined value, a gas concentration detected when the purge control valve is open (in the state where the purge gas is supplied) well reflects the concentration of the purge gas in the purge passage. On the other hand, when the duty cycle is less than the predetermined value, a period during which the purge control valve is closed and the purge gas is not supplied to the intake pipe is long. Due to this, in a case where the duty cycle is less than the predetermined value, a gas concentration detected while the purge control valve is closed (in the state where the purge gas is not supplied) well reflects the concentration of the purge gas in the purge passage. The above evaporated fuel processing device can accurately detect the purge gas concentration in the purge passage by detecting the purge gas concentration when the purge control valve is open in a case where the duty cycle is not less than the predetermined value, and by detecting the purge gas concentration when the purge control valve is closed in a case where the duty cycle is less than the predetermined value.

The concentration detector may comprise a pressure gauge provided between the purge control valve and the pump and configured to detect a pressure in the purge passage. In this case, the concentration detector may be configured to determine the concentration of the purge gas based on a detected value in the pressure gauge and a rotational speed of the pump. A pressure between the purge control valve and the pump (a pressure on a downstream side relative to the pump) changes depending on the concentration of the purge gas. Due to this, the concentration of the purge gas can be determined by providing the pressure gauge between the purge control valve and the pump and by detecting the pressure between the purge control valve and the pump. Here, "based on a detected value in the pressure gauge" includes both a detected value itself in the pressure gauge and a pressure difference between a detected value in the pressure gauge (pressure on the downstream side relative to the pump) and a pressure on an upstream side relative to the pump. Further, the pressure on the upstream side relative to the pump may be a pressure detected between the pump and the canister, or may be a pressure detected on an upstream side relative to the canister.

The concentration detector may comprise a storage unit storing a first table and a second table, wherein the first table defines a gas concentration corresponding to a rotational speed of the pump and a detected value in the pressure gauge when the purge control valve is open, and the second table defines a gas concentration corresponding to a rotational speed of the pump and a detected value in the pressure gauge when the purge control valve is closed. Further, the concentration detector may determine the concentration of the purge gas based on the first table when the duty cycle of the purge control valve is not less than the predetermined value and may determine the concentration of the purge gas based on the second table when the duty cycle of the purge control valve is less than the predetermined value. The pressure in the purge passage is lower when the purge control valve is open than when it is closed. By preparing the different tables corresponding to the states of the purge control valve (open and closed), the purge gas concentration can be detected more accurately.

A method of detecting a concentration of purge gas disclosed herein is executed in an evaporated fuel processing device that is configured to deliver the purge gas to an intake pipe of an engine from a canister to which evaporated fuel generated in a fuel tank adheres. The evaporated fuel processing device may comprise a purge passage connected between the canister and the intake pipe of the engine, a purge control valve configured to control a supply amount of the purge gas to the intake pipe by a duty cycle, a pump configured to feed the purge gas from the canister to the intake pipe, and a concentration detector configured to detect a concentration of the purge gas in the purge passage. This method of detecting a concentration of purge gas may comprise: determining whether the duty cycle of the purge control valve is not less than a predetermined value; in a case where the duty cycle of the purge control valve is not less than the predetermined value, detecting the concentration of the purge gas when the purge control valve is open while the pump is in operation, and in a case where the duty cycle of the purge control valve is less than the predetermined value, detecting the concentration of the purge gas when the purge control valve is closed while the pump is in operation.

A controller disclosed herein is configured to control an evaporated fuel processing device that is configured to deliver purge gas from a canister to which evaporated fuel generated in a fuel tank adheres to an intake pipe of an engine. The controller may be configured to: operate a pump configured to feed the purge gas from the canister to the intake pipe; switch a purge control valve to an open state or a closed state based on a duty cycle when the purge gas is delivered to the intake pipe, the purge control valve being provided on a purge passage connecting the intake pipe and the canister; in a case where the duty cycle is not less than a predetermined value, detect a concentration of the purge gas in the purge passage while the purge control valve is in the open state; and in a case where the duty cycle is less than the predetermined value, detect a concentration of the purge gas while the purge control valve is in the closed state. Using this controller allows control on an evaporated fuel processing device in which a purge control valve is provided on a purge passage between an intake pipe and a canister and a pump is provided on the purge passage between the purge control valve and the canister.

The controller may comprise a storage unit storing a first table and a second table, wherein the first table defines a gas concentration corresponding to a rotational speed of the pump and a detected value in a pressure gauge when the purge control valve is in the open state, and the second table defines a gas concentration corresponding to a rotational speed of the pump and a detected value in the pressure gauge when the purge control valve is in the closed state. In this case, the controller may determine the concentration of the purge gas based on the first table when the duty cycle of the purge control valve is not less than the predetermined value and may determine the concentration of the purge gas based on the second table when the duty cycle of the purge control valve is less than the predetermined value.

BRIEF DESCRIPTION OF DRAWINGS

FIG. 7 shows a first table;

FIG. 8 shows a second table;

DESCRIPTION OF EMBODIMENTS

First Embodiment

Figure 1:
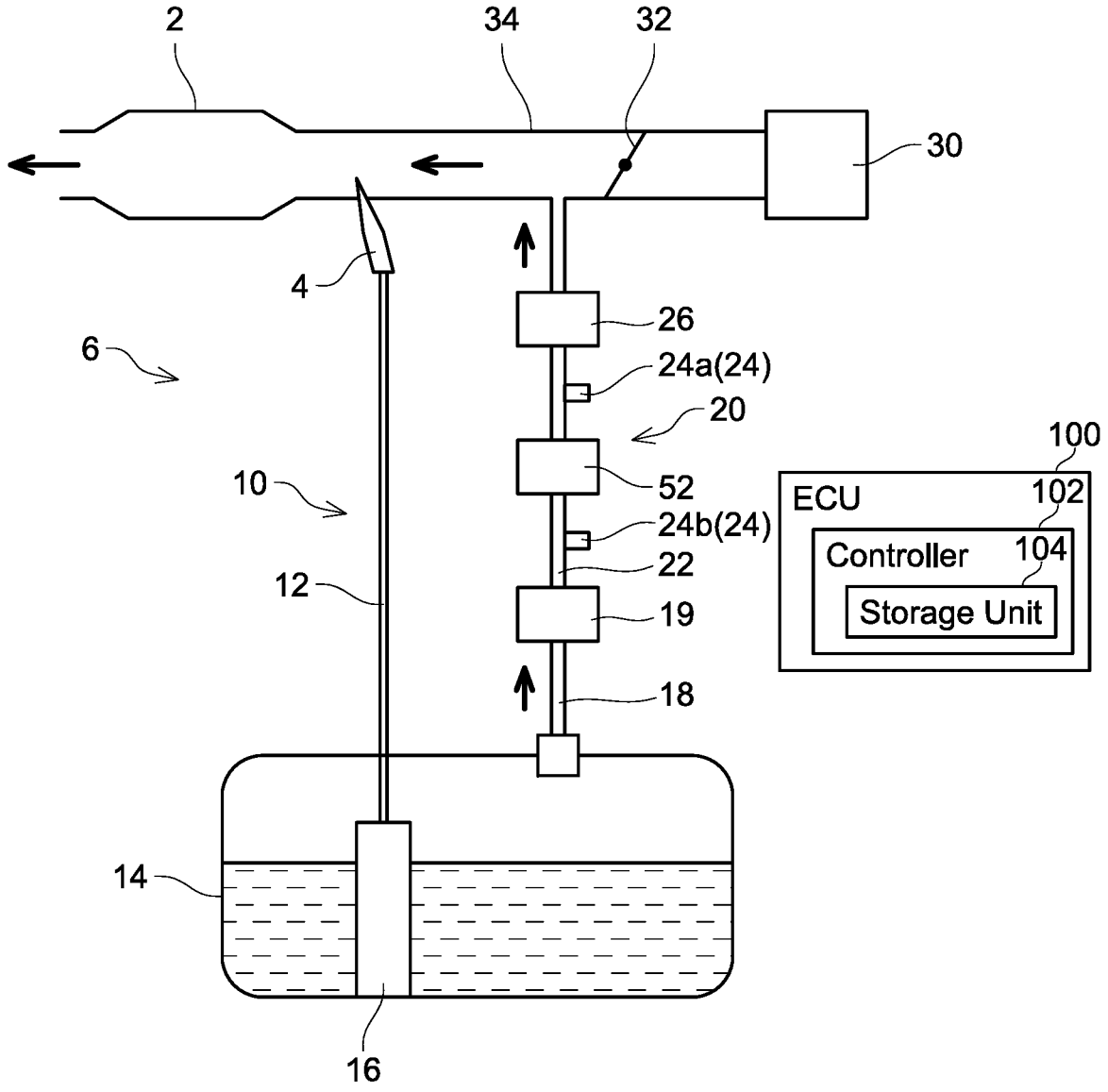
FIG. 1 shows a fuel supply system of a vehicle using an evaporated fuel processing device of a first embodiment.

A fuel supply system 6 provided with an evaporated fuel processing device 20 will be described with reference to FIGS. 1 and 2. As shown in FIG. 1, the fuel supply system 6 is provided with a main fuel supply device 10 for supplying fuel stored in a fuel tank 14 to an engine 2 and the evaporated fuel processing device 20 for supplying evaporated fuel generated in the fuel tank 14 to the engine 2.

The main fuel supply device 10 is provided with a fuel pump unit 16, a supply pipe 12, and an injector 4. The fuel pump unit 16 is provided with a fuel pump, a pressure regulator, a control circuit, and the like. The fuel pump unit 16 is configured to control the fuel pump according to signals supplied from a controller 102 in an ECU 100. The fuel pump is configured to boost a pressure of the fuel in the fuel tank 14 and discharge the same. The fuel discharged from the fuel pump is regulated by the pressure regulator and is then supplied to the supply pipe 12 from the fuel pump unit 16. The supply pipe 12 is connected to the fuel pump unit 16 and the injector 4. The fuel supplied to the supply pipe 12 flows through the supply pipe 12 and reaches the injector 4. The injector 4 includes a valve (not shown) of which aperture is controlled by the ECU 100. When the valve of the injector 4 is opened, the fuel in the supply pipe 12 is supplied to an intake pipe 34 that is connected to the engine 2.

The intake pipe 34 is connected to an air cleaner 30. The air cleaner 30 is provided with a filter for removing foreign particles in air that is to flow into the intake pipe 34. A throttle valve 32 is provided within the intake pipe 34. When the throttle valve 32 opens, air is suctioned from the air cleaner 30 toward the engine 2. The throttle valve 32 is configured to adjust an aperture of the intake pipe 34 to adjust an air amount flowing into the engine 2. The throttle valve 32 is provided on an upstream side (air cleaner 30 side) relative to the injector 4. The throttle valve 32 is controlled by the ECU 100. An air flowmeter (not shown) may be provided between the air cleaner 30 and the throttle valve 32 to detect the air amount flowing into the intake pipe 34.

The evaporated fuel processing device 20 includes a purge passage 22, a canister 19, a pump 52, a purge control valve 26, pressure gauges 24 (a first pressure gauge 24*a* and a second pressure gauge 24*b*). The purge passage 22 is connected to the intake passage 34 between the injector 4 and the throttle valve 32. Purge gas that flows from the canister 19 to the intake pipe 34 passes through the purge passage 22. The canister 19 and the fuel tank 14 are connected by a communication pipe 18. The evaporated fuel generated in the fuel tank 14 adheres to the canister 19. The pump 52 is configured to feed, to the intake pipe 34, the purge gas containing the evaporated fuel adhering to the canister 19. The purge control valve 26 is a solenoid valve controlled by the ECU 100 (controller 102) and is configured to switch between a supply state of allowing the purge gas to be supplied and a blocking state of blocking supply of the purge gas. The purge control valve 26 is duty-controlled by the ECU 100 and is configured to adjust a flow rate of the purge gas to be fed to the intake pipe 34 by controlling timings to open and close in the supply state (switching timings between an open state and a closed state). In the evaporated fuel processing device 20, a purge gas concentration is detected based on detected values in the pressure gauges 24 and by using information stored in a storage unit (memory) 104. The information stored in the storage unit 104 will be described later.

Figure 2:
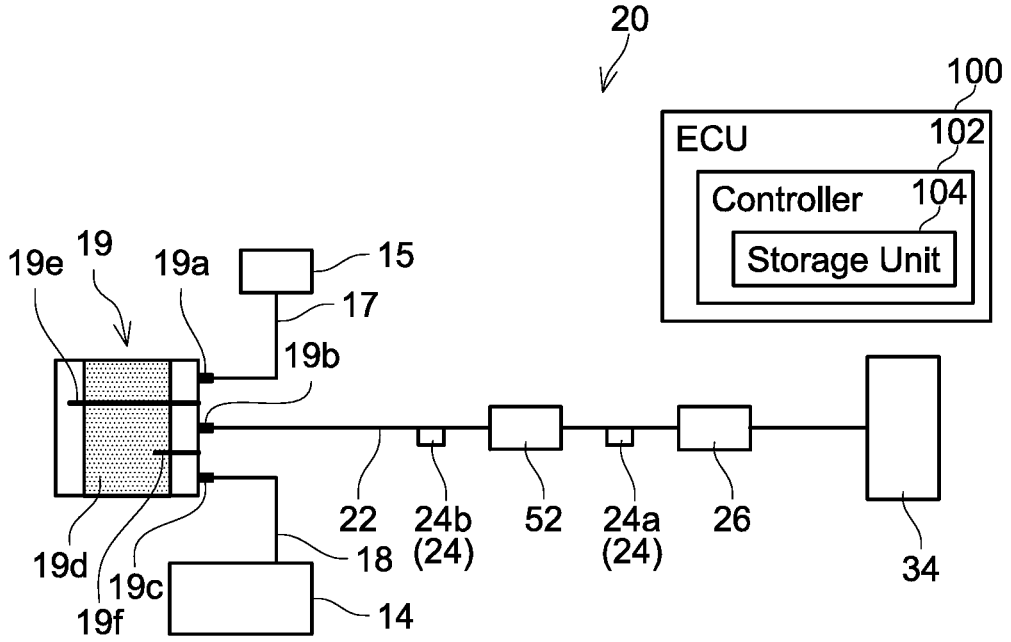
FIG. 2 shows the evaporated fuel processing device of the first embodiment.

As shown in FIG. 2, the canister 19 is provided with an open air port 19*a*, a purge port 19*b*, and a tank port 19*c*. The open air port 19*a* is connected to an air filter 15 via a communication pipe 17. The purge port 19*b* is connected to the purge passage 22. The tank port 19*c* is connected to the fuel tank 14 via the communication pipe 18. Activated carbon 19*d* is accommodated in the canister 19. The ports 19*a*, 19*b* and 19*c* are provided on one of wall surfaces of the canister 19 that face the activated carbon 19*d*. A space is provided between the activated carbon 19*d* and the inner wall of the canister 19 where the ports 19*a*, 19*b*, 19*c* are provided. A first partition plate 19*e* and a second partition plate 19*f* are fixed to the inner wall of the canister 19 where the ports 19*a*, 19*b*, 19*c* are provided. The first partition plate 19*e* partitions the space between the activated carbon 19*d* and the inner wall of the canister 19 at a position between the open air port 19*a* and the purge port 19*b*. The first partition plate 19*e* extends into a space opposite from a side where the ports 19*a*, 19*b*, 19*c* are provided. The second partition plate 19*f* partitions the space between the activated carbon 19*d* and the inner wall of the canister 19 at a position between the purge port 19*b* and the tank port 19*c*.

The activated carbon 19*d* is configured to adsorb the evaporated fuel from gas that flows into the canister 19 from the fuel tank 14 through the communication pipe 18 and the tank port 19*c*. Gas from which the evaporated fuel has been adsorbed is discharged to open air through the open air port 19*a*, the communication pipe 17, and the air filter 15. The canister 19 can suppress the evaporated fuel in the fuel tank 14 from being discharged to open air. The evaporated fuel adsorbed by the activated carbon 19*d* is supplied to the purge passage 22 from the purge port 19*b*. The first partition plate 19*e* partitions the space where the open air port 19*a* is connected from the space where the purge port 19*b* is connected. The first partition plate 19*e* suppresses the gas containing the evaporated fuel from being discharged to open air. The second partition plate 19*f* partitions the space where the purge port 19*b* is connected from the space where the tank port 19*c* is connected. The second partition plate 19*f* suppresses the gas flowing into the canister 19 from the tank port 19*c* from directly flowing into the purge passage 22.

The purge passage 22 connects the canister 19 and the intake pipe 34. The pump 52, the purge control valve 26, and the pressure gauges 24 are provided on the purge passage 22. The pump 52 is provided between the canister 19 and the purge control valve 26 and pumps the evaporated fuel (purge gas) into the intake pipe 34. When the engine 2 is in operation, the intake pipe 34 has a negative pressure therein. Due to this, the evaporated fuel adhering to the canister 19 can be introduced to the intake pipe 34 by using a pressure difference between the intake pipe 34 and the canister 19. However, providing the pump 52 on the purge passage 22 allows supply of the evaporated fuel adhering to the canister 19 to the intake pipe 34 even when the intake pipe 34 has a pressure that is not sufficient to draw in the purge gas (such as a positive pressure in a supercharged state or a negative pressure with a small absolute pressure value). Further, providing the pump 52 allows supply of a desired amount of the evaporated fuel to the intake pipe 34. The pump 52 is controlled by the ECU 100 (controller 102). When the intake pipe 34 has a negative pressure therein, the purge gas can be introduced to the intake pipe 34 without the pump 52 being operated. Although details will be described later, the evaporated fuel processing device 20 operates the pump 52 when detecting a purge gas concentration, regardless of the pressure inside the intake pipe 34.

Figure 3:
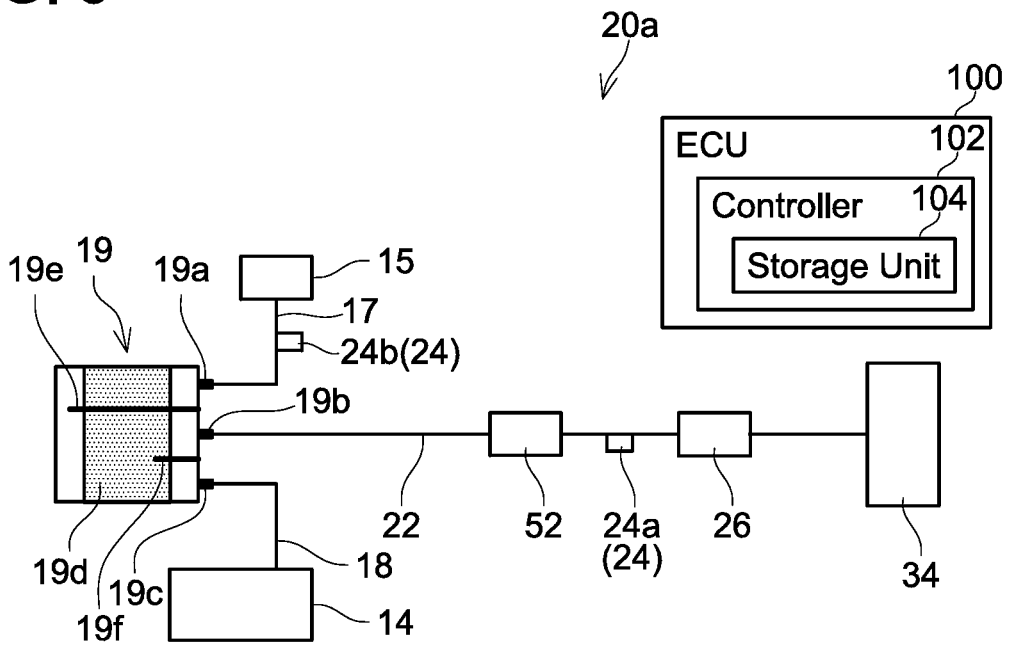
FIG. 3 shows a variant of the evaporated fuel processing device of the first embodiment.
Figure 4:
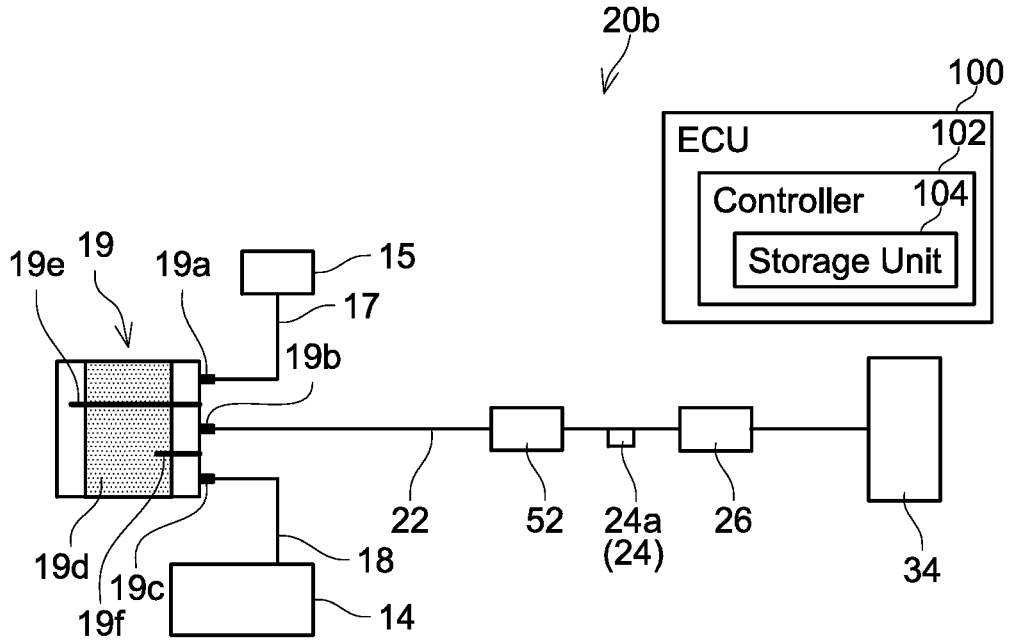
FIG. 4 shows a variant of the evaporated fuel processing device of the first embodiment.

The pressure gauges 24 are provided on upstream and downstream sides relative to the pump 52. Specifically, the first pressure gauge 24*a* is provided between the purge control valve 26 and the pump 52 (on the downstream side relative to the pump 52), and the second pressure gauge 24*b* is provided between the pump 52 and the canister 19 (on the upstream side relative to the pump 52). By detecting pressures in the purge passage 22 by the first pressure gauge 24*a* and the second pressure gauge 24*b*, a pressure difference between the upstream and downstream sides relative to the pump 52 can be calculated. The higher a gas density in the purge passage 22 becomes, the larger detected values of the pressure gauges 24 become. In the evaporated fuel processing device 20, a purge gas concentration is detected based on the detected values of the pressure gauges 24. The detected values of the pressure gauges 24 are inputted to the ECU 100 (controller 102). As in an evaporated fuel processing device 20*a* shown in FIG. 3, the second pressure gauge 24*b* provided on the upstream side relative to the pump 52 may be provided between the air filter 15 and the canister 19 (on the communication pipe 17). In this case as well, the pressure gauges 24 are provided on the upstream and downstream sides relative to the pump 52. Alternatively, as in an evaporated fuel processing device 20*b* shown in FIG. 4, no pressure gauge may be provided on the upstream side relative to the pump 52, and the pressure gauge 24 (first pressure gauge 24*a*) may be provided only on the downstream side relative to the pump 52 (between the pump 52 and the purge control valve 26).

The ECU 100 is provided with the controller 102 configured to control the evaporated fuel processing device 20. The controller 102 is configured integrally with other portions of the ECU 100 (such as a portion for controlling the engine 2). The controller 102 may be provided separately from the other portions of the ECU 100. That is, the controller 102 may be a controller independent from the ECU 100. The controller 102 includes a CPU and the storage unit (memory) 104 such as a ROM and a RAM. The storage unit 104 stores tables in which purge gas concentrations corresponding to the detected values of the pressure gauge 24 and the rotational speeds of the pump 52 are described. The controller 102 is configured to control the evaporated fuel processing device 20 according to a program that is pre-stored in the storage unit 104. Specifically, the controller 102 is configured to output signals to the pump 52 to control on/off of the pump 52 and the rotational speed of the pump 52. Further, the controller 102 is configured to output signals to the purge control valve 26 to execute duty control. The controller 102 is configured to adjust an open duration of the purge control valve 26 by adjusting a duty cycle of the signals outputted to the purge control valve 26. Further, the controller 102 is configured to determine a purge gas concentration by referring to the tables stored in the storage unit 104 (tables in which the purge gas concentrations corresponding to the detected values of the pressure gauges 24 and the rotational speeds of the pump 52 are described) based on the detected values of the pressure gauges 24.

In the evaporated fuel processing device 20, the purge control valve 26 is repeatedly opened and closed based on the duty cycle while purge is executed (while the purge gas is supplied to the intake pipe 34) in order to adjust a supply amount of the purge gas to the intake passage 34. In the evaporated fuel processing device 20, a timing to detect the purge gas concentration is varied based on the duty cycle. Specifically, the purge gas concentration is detected when the purge control valve 26 is closed in a case where the duty cycle is less than a predetermined value (such as 50%). On the other hand, the purge gas concentration is detected when the purge control valve 26 is open in a case where the duty cycle is at the predetermined value.

A method of detecting the purge gas concentration will be described with reference to FIGS. 5 and 6. FIG. 6 shows an operation of the purge control valve 26, detected values of the pressure gauges 24, and the purge gas concentration from when the purge gas supply is started at timing t1 until when the purge gas supply is stopped at timing t14. FIG. 6 shows an example where the duty cycle changes from a value that is less than a predetermined value α to a value that is not less than the predetermined value α during the purge gas supply (between timings t8 and t9). FIG. 6 shows an example in which the purge gas concentration gradually increases. This phenomenon is not caused by detection of the purge gas concentration. That is, detection of the purge gas concentration to be described hereinbelow does not affect changes in the purge gas concentration.

Figure 5:
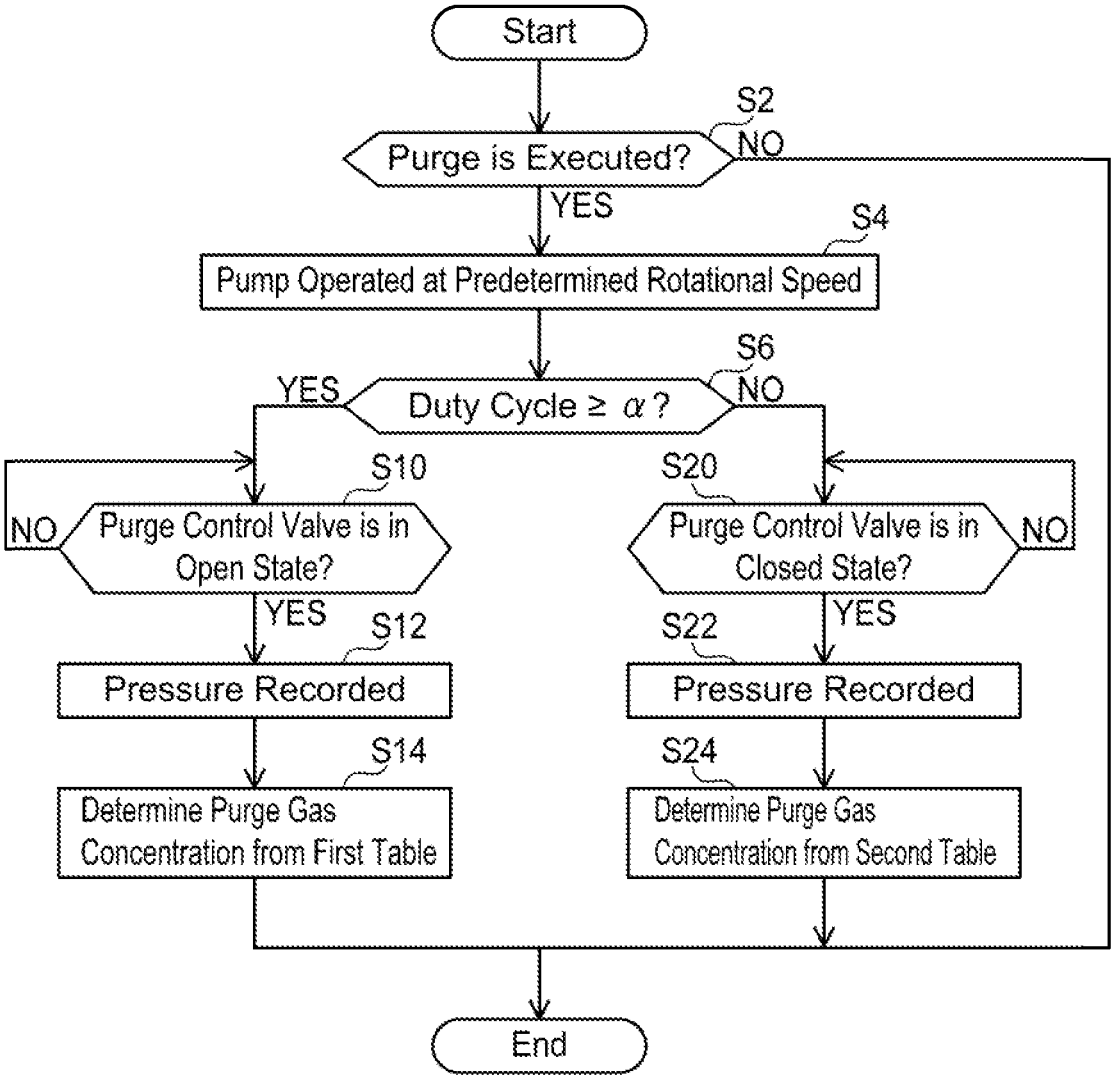
FIG. 5 shows a flowchart for a method of detecting a purge gas concentration.
Figure 6:
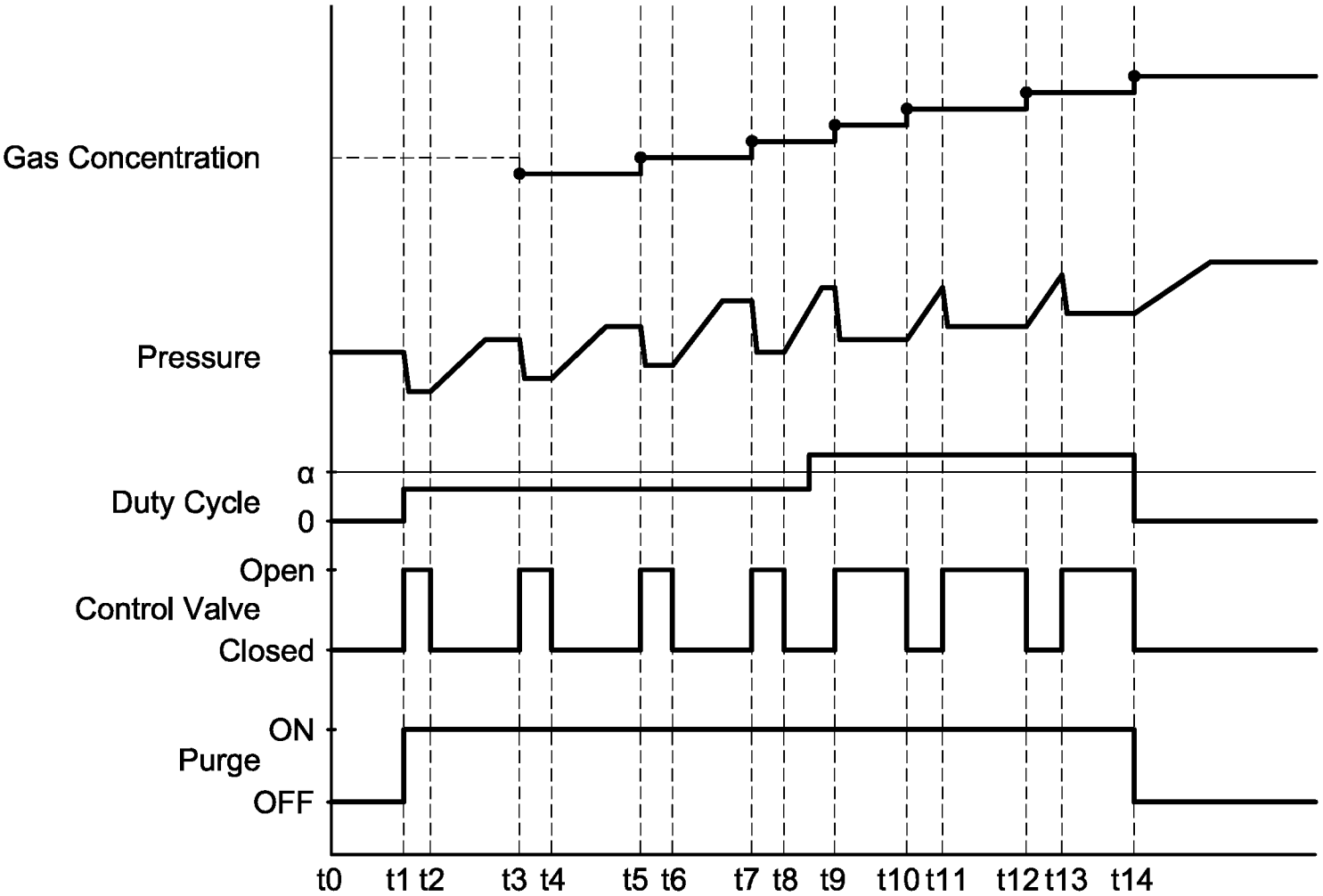
FIG. 6 shows a timing chart while purge is executed.

As shown in FIG. 5, firstly, a determination is made on whether a purge execution flag (flag indicating supply of the purge gas) is on or not (step S2). In the evaporated fuel processing device 20, the concentration is detected while the purge gas is supplied to the intake pipe 34. Due to this, the purge gas concentration is not detected in a case where the purge execution flag is not on (in a case where the purge gas is not supplied) (step S2: NO). In a case where the purge execution flag is on (step S2: YES), the pump 52 is operated at a predetermined rotational speed (step S4), the purge control valve 26 is controlled by a predetermined duty cycle, and then purge is started (timing t1). The operation of the pump 52 and the control of the purge control valve 26 are executed by the controller 102 of the ECU 100 (see also FIGS. 1 and 2). When the purge execution flag is switched from off to on, the rotational speed of the pump 52 and the duty cycle of the purge control valve 26 are adjusted based on the purge gas concentration that was measured while previous purge was executed (shown by a broken line in FIG. 6).

The purge control valve 26 switches between the open state (timings t1 to t2, t3 to t4) and the closed state (timings t2 to t3, t4 to t5) based on the duty control of the controller 102. The duty cycle is a ratio of a period in which the purge control valve 26 is maintained in the open state (period from timing t1 to timing t2) within one cycle, where the one cycle is a period from when the purge control valve 26 switches to the open state until when the purge control valve 26 switches to the open state again after having switched to the closed state (such as a period from timing t1 to timing t3). The smaller the duty cycle is, the shorter the period in which the purge control valve 26 is maintained in the open state is. In this detection method, a timing to detect the purge gas concentration is varied depending on whether the duty cycle is not less than the predetermined value α. The predetermined value α may be from 40% to 60%, and is 50% in this embodiment.

In a case where the duty cycle is less than the predetermined value α (step S6: NO, timings t1 to t8), a pressure (pressure difference between the first pressure gauge 24*a* and the second pressure gauge 24*b*) is detected when the purge control valve 26 is in the closed state (step S20: YES, timings t2 to t3, t4 to t5, t6 to t7), and is recorded (step S22). For the pressure (pressure difference), a value of its peak value (maximum value) is detected and recorded. Then, the purge gas concentration is determined from a second table (see FIG. 8) based on the recorded pressure (step S24). The detected pressure to be recorded may be an average of pressures detected during the purge control valve 26 being maintained in the closed state.

In a case where the duty cycle is not less than the predetermined value α (step S6: YES, timings t9 to t14), a pressure is detected when the purge control valve 26 is in the open state (step S10: YES, timings t9 to t10, t11 to t12, t13 to t14), and is recorded (step S12). For the pressure, a value of its peak value (maximum value) is detected and recorded. Then, the purge gas concentration is determined from a first table (see FIG. 7) based on the recorded pressure (step S14). The detected pressure to be recorded may be an average of pressures detected during the purge control valve 26 being maintained in the open state. Details of the first and second tables will be described later.

As shown in FIG. 6, the detected values of the pressure gauges 24 (pressure difference) for determining the purge gas concentration vary depending on the open and closed states of the purge control valve 26. Due to this, even if the purge gas concentration is detected (pressure in the purge passage 22 is detected) at an arbitrary timing while purge is executed, an accurate gas concentration cannot be detected. In the evaporated fuel processing device 20, a timing to detect the gas concentration is varied depending on the duty cycle of the purge control valve 26 while purge is executed. Specifically, in a case where the duty cycle is less than the predetermined value α and the purge control valve 26 is maintained in the closed state for a long period of time, the purge gas concentration is determined based on a pressure detected when the purge control valve 26 is in the closed state. Further, in a case where the duty cycle is not less than the predetermined value α and the purge control valve 26 is maintained in the open state for a long period of time, the purge gas concentration is determined based on a pressure detected when the purge control valve 26 is in the open state.

The evaporated fuel processing device 20 can detect a gas concentration more accurately than conventional evaporated fuel processing devices by detecting the purge gas concentration at a timing which more accurately reflects the purge gas concentration (that is, the pressure) in the purge passage 22.

Further, as described above, in the evaporated fuel processing device 20, the different tables are used to determine the purge gas concentration depending on whether the duty cycle is not less than the predetermined value α (detecting a pressure in the open state) or the duty cycle is less than the predetermined value α (detecting a pressure in the closed state). Due to this, an accurate gas concentration is detected regardless of whether a pressure is detected in the open state where the pressure tends to be detected low or a pressure is detected in the closed state where the pressure tends to be detected high.

Here, the first table (FIG. 7) and the second table (FIG. 8) will be described. FIG. 7 shows the first table that records, for each rotational speed of the pump 52, relationships between the purge gas concentrations and pressure differences ΔP between the upstream and downstream sides relative to the pump 52 (detected value of the first pressure gauge 24*a*—detected value of the second pressure gauge 24*b*) detected while the pump 52 is in operation with the purge control valve 26 in the open state. For the same rotational speed of the pump 52, the higher the purge gas concentration becomes, the larger the pressure difference ΔP becomes. Further, for the same pressure difference ΔP, the lower the purge gas concentration becomes, the faster the rotational speed of the pump 52 becomes. For example, a concentration B11 is higher than a concentration B2, and a concentration D11 is lower than the concentration B11.

FIG. 8 shows the second table that records, for each rotational speed of the pump 52, relationships between the purge gas concentrations and pressure differences ΔP between the upstream and downstream sides relative to the pump 52 (detected value of the first pressure gauge 24*a*—detected value of the second pressure gauge 24*b*) detected while the pump 52 is in operation with the purge control valve 26 in the closed state. In the second table as well, for the same rotational speed of the pump 52, the higher the purge gas concentration becomes, the larger the pressure difference ΔP becomes. Further, for the same pressure difference ΔP, the lower the purge gas concentration becomes, the faster the rotational speed of the pump 52 becomes. While the pump 52 is in operation with the purge control valve 26 in the closed state, the pressure on the downstream side relative to the pump (the detected value of the first pressure gauge 24*a*) becomes higher than that when the purge control valve 26 is in the open state (see also FIG. 6). Due to this, when compared for the same pressure difference ΔP and the same rotational speed of the pump 52, the gas concentration recorded in the second table is not more than the gas concentration recorded in the first table. For example, a concentration a10 is lower than a concentration A10, and a concentration d5 is lower than a concentration D5.

In the above embodiment, the first table and the second table are stored in the storage unit 104, and the purge gas concentration is determined by referring to the first table or the second table based on the duty cycle of the purge control valve 26. However, the storage unit 104 may store a first function related to the rotational speed of the pump 52 and the pressure (pressure difference) when the purge control valve 26 is in the open state and a second function related to the rotational speed of the pump 52 and the pressure when the purge control valve 26 is in the closed state, and the purge gas concentration may be determined by referring to the first function or the second function based on the duty cycle of the purge control valve 26. In this case, step S14 of FIG. 5 is read as "determine the purge gas concentration by using the first function" and step S24 thereof is read as "determine the purge gas concentration by using the second function". Further, in a case of detecting the purge gas concentration in the evaporated fuel processing device 20*b* (see FIG. 4), the storage unit 104 stores the purge gas concentration based on the rotational speed of the pump 52 and the pressure of the first pressure gauge 24*a* as a table (or a function).

Second Embodiment

Figure 9:
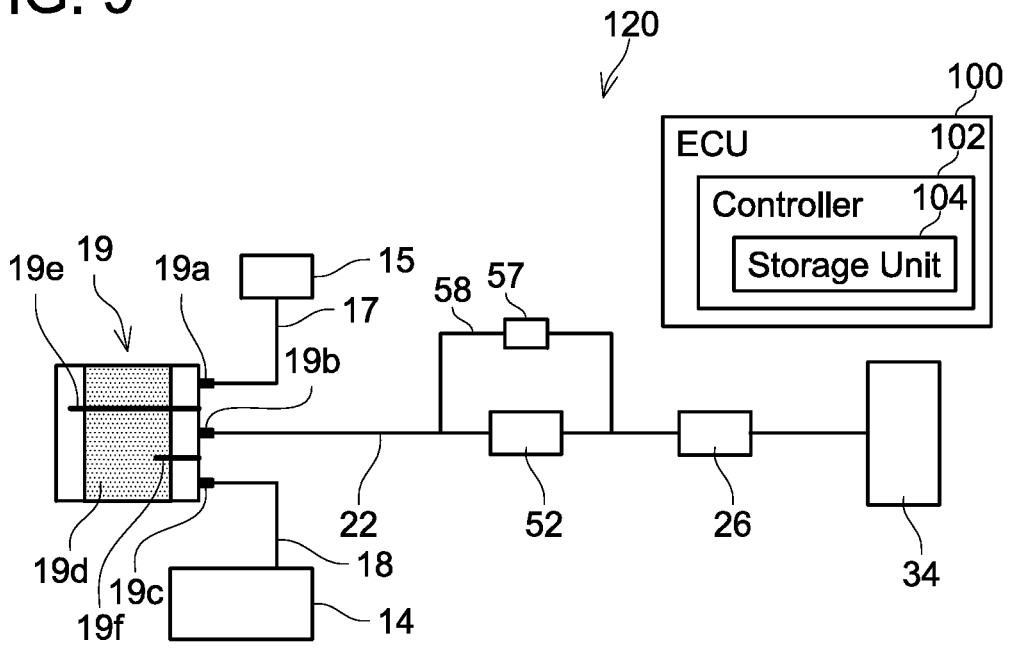
FIG. 9 shows an evaporated fuel processing device of a second embodiment.

An evaporated fuel processing device 120 will be described with reference to FIG. 9. The evaporated fuel processing device 120 is a variant of the evaporated fuel processing device 20. The evaporated fuel processing device 120 differs from the evaporated fuel processing device 20 in that no pressure gauge (no pressure detector) is provided on the purge passage 22. For the evaporated fuel processing device 120, same configurations as those of the evaporated fuel processing device 20 are given the same reference signs and the descriptions thereof may be omitted.

The evaporated fuel processing device 120 is provided with a branch passage 58 having one end thereof connected to the purge passage 22 on the upstream side relative to the pump 52 and having another end thereof connected to the purge passage 22 on the downstream side relative to the pump 52. A concentration sensor 57 is provided on the branch passage 58. The evaporated fuel processing device 120 is configured to determine the purge gas concentration based on a detected value of the concentration sensor 57. As the concentration sensor 57, various types of sensors may be used. Hereinbelow, some available examples for the concentration sensor 57 will be described with reference to FIGS. 10 to 13.

Figure 10:
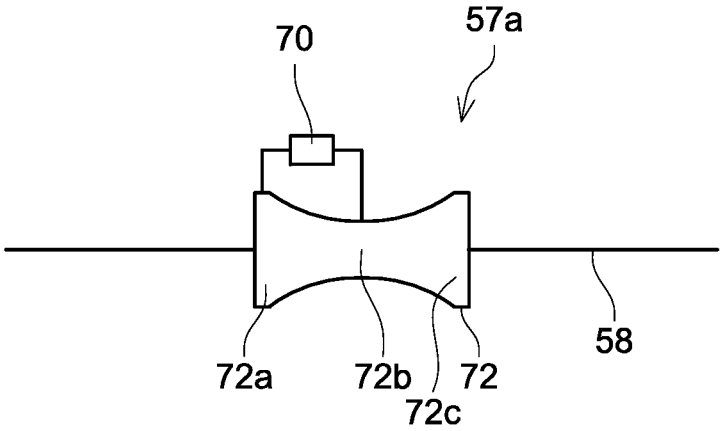
FIG. 10 shows a specific example of a concentration detector in the evaporated fuel processing device of the second embodiment.

FIG. 10 shows a concentration sensor 57*a* including a venturi pipe 72. Ends of the venturi pipe 72 (a first end 72*a* and a second end portion 72*c*) are connected to the branch passage 58. The first end 72*a* is connected to the downstream side relative to the pump 52 (high-pressure side), and the second end 72*c* is connected to the upstream side relative to the pump 52 (low-pressure side). Due to this, the purge gas flows from the first end 72*a* toward the second end 72*c*. A differential pressure sensor 70 is connected between the first end 72*a* and a center portion (narrowed portion) 72*c* of the venturi pipe 72. The concentration sensor 57*a* is configured to detect a pressure difference between the first end 72*a* and the center portion 72*b* by the differential pressure sensor 70. In a case of using the concentration sensor 57*a*, a detected value of the differential pressure sensor 70 is recorded in step S12 or S22 of FIG. 5. By detecting the pressure difference between the first end 72*a* and the center portion 72*b*, a purge gas density (purge gas concentration) can be calculated by using a Bernoulli's equation.

Figure 11:
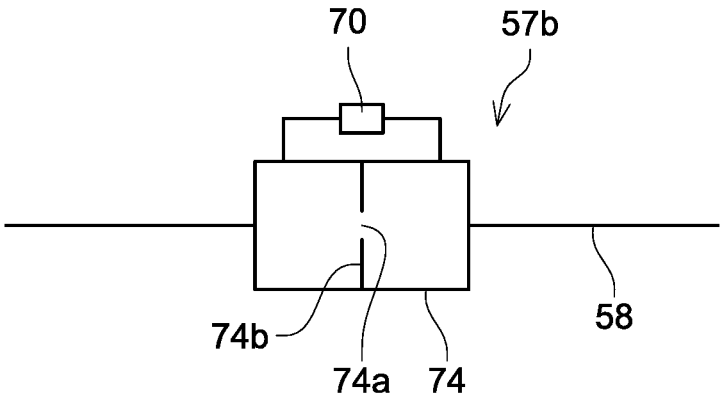
FIG. 11 shows a specific example of the concentration detector in the evaporated fuel processing device of the second embodiment.

FIG. 11 shows a concentration sensor 57*b* including an orifice pipe 74. Both ends of the orifice pipe 74 are connected to the branch passage 58. An orifice plate 74*b* having a hole 74*a* is provided at a center of the orifice pipe 74. The differential pressure sensor 70 is connected to an upstream side and a downstream side relative to the orifice plate 74*b*. The concentration sensor 57*b* is configured to detect a pressure difference between the upstream side and the downstream side relative to the orifice plate 74*b* by the differential pressure sensor 70. In this case of using the concentration sensor 57*b* as well, a detected value of the differential pressure sensor 70 is recorded in step S12 or S22 of FIG. 5.

Figure 12:
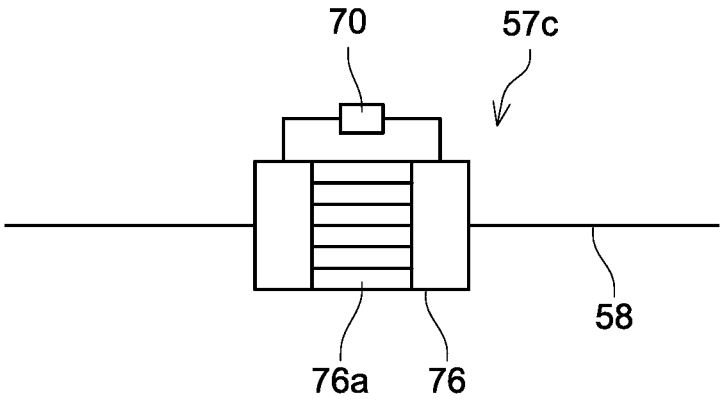
FIG. 12 shows a specific example of the concentration detector in the evaporated fuel processing device of the second embodiment.

FIG. 12 shows a concentration sensor 57*c* including a capillary viscometer 76. Both ends of the capillary viscometer 76 are connected to the branch passage 58. A plurality of capillary pipes 76*a* is provided within the capillary viscometer 76. The differential pressure sensor 70 is connected to an upstream side and a downstream side relative to the capillary pipes 76*a*. The concentration sensor 57*c* is configured to detect a pressure difference between the upstream side and the downstream side relative to the capillary pipes 76*a* by the differential pressure sensor 70 and measure viscosity of fluid (purge gas) passing through the capillary viscometer 76. By detecting the pressure difference between the upstream side and the downstream side relative to the capillary pipes 76*a*, the viscosity of the fluid can be calculated by a Hagen-Poiseuille equation. The viscosity of the purge gas has a correlation with the purge gas concentration. Due to this, by calculating the viscosity of the purge gas, the purge gas concentration can be detected. In this case of using the concentration sensor 57*c* (capillary viscometer 76) as well, a detected value of the differential pressure sensor 70 is recorded in step S12 or S22 of FIG. 5. In case of using any of the concentration sensors 57*a* to 57*c*, the storage unit 104 stores a table that describes the purge gas concentration corresponding to the rotational speed of the pump 52 and the detected value of the differential pressure sensor 70 (or alternatively, the purge gas concentration corresponding to the rotational speed of the pump 52 and viscosity).

Figure 13:
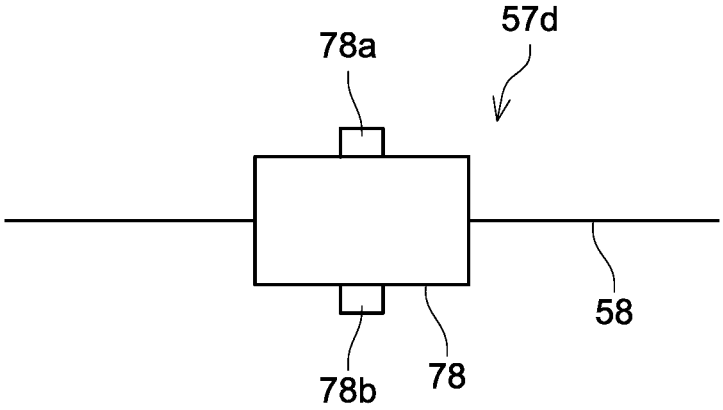
FIG. 13 shows a specific example of the concentration detector in the evaporated fuel processing device of the second embodiment.

FIG. 13 shows a concentration sensor 57*d* including a sonic densitometer 78. The sonic densitometer 78 has a tubular shape, and both ends thereof are connected to the branch passage 58. The sonic densitometer 78 is provided with a transmitter 78*a* that transmits a signal toward inside of the tube and a receiver 78*b* that receives the signal which the transmitter 78*a* had transmitted. In the sonic densitometer 78, a time t which the signal takes to arrive at the receiver 78*b* from the transmitter 78*a* is detected. A sonic speed v within the tube is calculated based on the time t and a distance L between the transmitter 78*a* and the receiver 78*b*. The sonic speed v within the tube has a correlation with the concentration of purge gas passing through the tube. By measuring the sonic speed v within the tube, the purge gas concentration (a molecular weight of the purge gas) can be detected. Specifically, it is known that the following equation (1) is satisfied, where v is the sonic speed, M is molecular weight of the purge gas, γ is a specific heat ratio, R is a gas constant, and T is an absolute temperature. The purge gas concentration can be detected by using the following equation (1). In the case of using the sonic densitometer 78, the sonic speed v within the tube is recorded in step S12, S22 of FIG. 5. Further, a table (or a function) that describes the purge gas concentration corresponding to the rotational speed of the pump 52 and the sonic speed v is in the storage unit 104 for determining the purge gas concentration.

$$v=(\gamma\times R\times T/M)^{0.5} \qquad \text{Equation (1):}$$

Several examples were given above regarding configurations of the pressure detector. What is important is that in an evaporated fuel processing device that is provided with a concentration detector configured to detect a concentration of purge gas in a purge passage and in which a purge control valve, which is configured to be controlled by duty cycle, is provided on the purge passage between a canister and an intake pipe and a pump is provided on the purge passage on an upstream side relative to the purge control valve, while the pump is in operation, the purge gas is determined based on a detected value of the concentration detector when the purge control valve is open in a case where a duty cycle of the purge control valve is not less than a predetermined value, and the purge gas is determined based on a detected value of the concentration detector when the purge control valve is closed in a case where the duty cycle of the purge control valve is less than a predetermined value. For example, in the disclosure herein, the purge pump 52 is provided on the purge passage 22 between the purge control valve 26 and the canister 19, however, the purge pump 52 may be provided between the canister 19 and the air filter 15 and a pressure sensor (or a concentration sensor) may be provided on a downstream side relative to the purge pump 52 (on the communication pipe 17 or the purge passage 22). The method of detecting a purge gas concentration disclosed herein may be adapted to any type of evaporated fuel processing devices, so long as they are provided with a purge control valve that is configured to be controlled by duty cycle, a pump, and a concentration detector. Further, the controller (or the ECU provided with the controller) disclosed herein may be used as a controller for any type of evaporated fuel processing devices, so long as they are provided with a purge control valve that is configured to be controlled by duty cycle, a pump, and a concentration detector.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. An evaporated fuel processing device comprising:

a canister to which evaporated fuel generated in a fuel tank adheres;

a purge passage connected between the canister and an intake pipe of an engine, and through which purge gas delivered from the canister to the intake pipe passes;

a purge control valve provided on the purge passage and configured to switch between a supply state of allowing the purge gas to be supplied from the canister to the intake pipe and a blocking state of blocking supply of the purge gas from the canister to the intake pipe, the purge control valve being configured to control a supply amount of the purge gas to the intake pipe by a duty cycle in the supply state;

a pump configured to feed the purge gas from the canister to the intake pipe; and a concentration detector configured to detect a concentration of the purge gas in the purge passage, wherein while the purge control valve is in the supply state and the pump is in operation, the concentration detector varies a timing to detect the purge gas concentration based on the duty cycle, the concentration detector detects a concentration of the purge gas as the concentration of the purge gas in the supply state when the purge control valve is open in a case where the duty cycle of the purge control valve is not less than a predetermined value, and detects a concentration of the purge gas as the concentration of the purge gas in the supply state when the purge control valve is closed in a case where the duty cycle of the purge control valve is less than the predetermined value, wherein the predetermined value is greater than 0.

2. The evaporated fuel processing device according to claim 1, wherein the concentration detector comprises a pressure gauge provided between the purge control valve and the pump and configured to detect a pressure in the purge passage, and the concentration detector is configured to determine the concentration of the purge gas based on a detected value in the pressure gauge and a rotational speed of the pump.

3. The evaporated fuel processing device according to claim 2, wherein the concentration detector comprises a storage unit storing a first table and a second table, wherein the first table defines a gas concentration corresponding to a rotational speed of the pump and a detected value in the pressure gauge when the purge control valve is open, and the second table defines a gas concentration corresponding to a rotational speed of the pump and a detected value in the pressure gauge when the purge control valve is closed, and the concentration detector determines the concentration of the purge gas based on the first table when the duty cycle of the purge control valve is not less than the predetermined value and determines the concentration of the purge gas based on the second table when the duty cycle of the purge control valve is less than the predetermined value.

4. A method of detecting a concentration of purge gas delivered to an intake pipe of an engine in an evaporated fuel processing device configured to deliver the purge gas to the intake pipe from a canister to which evaporated fuel generated in a fuel tank adheres, wherein the evaporated fuel processing device comprises a purge passage connected between the canister and the intake pipe of the engine, a purge control valve configured to control a supply amount of the purge gas to the intake pipe by a duty cycle, a pump configured to feed the purge gas from the canister to the intake pipe, and a concentration detector configured to detect a concentration of the purge gas in the purge passage, wherein the method comprises:

determining whether the duty cycle of the purge control valve is not less than a predetermined value;

varying a timing to detect the purge gas concentration based on the determined duty cycle, in a case where the duty cycle of the purge control valve is not less than the predetermined value, detecting the concentration of the purge gas as the concentration of the purge gas in a supply state when the purge control valve is open while the pump is in operation, and in a case where the duty cycle of the purge control valve is less than the predetermined value, detecting the concentration of the purge gas as the concentration of the purge gas in the supply state when the purge control valve is closed while the pump is in operation, wherein the predetermined value is greater than 0.

5. A controller of an evaporated fuel processing device configured to deliver purge gas from a canister to which evaporated fuel generated in a fuel tank adheres to an intake pipe of an engine, the controller configured to:

operate a pump configured to feed the purge gas from the canister to the intake pipe;

switch a purge control valve to an open state or a closed state based on a duty cycle when the purge gas is delivered to the intake pipe, the purge control valve being provided on a purge passage connecting the intake pipe and the canister;

vary a timing to detect the purge gas concentration based on the duty cycle, in a case where the duty cycle is not less than a predetermined value, detect a concentration of the purge gas in the purge passage as the concentration of the purge gas in a supply state while the purge control valve is in the open state; and in a case where the duty cycle is less than the predetermined value, detect a concentration of the purge gas in the purge passage as the concentration of the purge gas in the supply state while the purge control valve is in the closed state, wherein the predetermined value is greater than 0.

6. The controller according to claim 5, wherein the controller comprises a storage unit storing a first table and a second table, wherein the first table defines a gas concentration corresponding to a rotational speed of the pump and a detected value in a pressure gauge when the purge control valve is in the open state, and the second table defines a gas concentration corresponding to a rotational speed of the pump and a detected value in the pressure gauge when the purge control valve is in the closed state, and the controller determines the concentration of the purge gas based on the first table when the duty cycle of the purge control valve is not less than the predetermined value and determines the concentration of the purge gas based on the second table when the duty cycle of the purge control valve is less than the predetermined value.

7. The evaporated fuel processing device according to claim 1, wherein the predetermined value is from 40% to 60%.

8. A method according to claim 4, wherein the predetermined value is from 40% to 60%.

9. The controller according to claim 5, wherein the predetermined value is from 40% to 60%.

* * * * *